US005107963A

United States Patent [19]

Rocca et al.

[11] Patent Number: 5,107,963

[45] Date of Patent: Apr. 28, 1992

[54] SPRING LOADED GUIDE ROLLERS

[75] Inventors: Dario M. Rocca; Gary B. Howey, both of New Liskeard, Canada

[73] Assignee: Norcast Corporation, Ontario, Canada

[21] Appl. No.: 583,174

[22] Filed: Sep. 14, 1990

Related U.S. Application Data

[63] Continuation-in-part of Ser. No. 476,095, Jan. 29, 1990, and a continuation-in-part of Ser. No. 219,595, Jul. 15, 1988, abandoned.

[51] Int. Cl.[5] ..... B66B 7/02

[52] U.S. Cl. ..... 187/95; 267/168

[58] Field of Search ..... 187/95; 267/168, 170

[56] References Cited

U.S. PATENT DOCUMENTS

| | | | |
|---|---|---|---|
| 2,100,169 | 11/1937 | Norton | 187/95 |
| 2,260,728 | 10/1941 | Somervell | 187/95 |
| 2,260,922 | 10/1941 | Spiro | 187/95 |
| 3,099,334 | 7/1963 | Tucker, Jr. | 187/95 |
| 4,434,876 | 3/1984 | McKechnie | 187/95 |

FOREIGN PATENT DOCUMENTS

| | | | |
|---|---|---|---|
| 1067195 | 10/1959 | Fed. Rep. of Germany | 187/95 |
| 1215321 | 4/1966 | Fed. Rep. of Germany | 187/95 |

*Primary Examiner*—Joseph E. Valenza
*Assistant Examiner*—Kenneth Noland
*Attorney, Agent, or Firm*—Weingarten, Schurgin, Gagnebin & Hayes

[57] ABSTRACT

A hoist or skip conveyance for high speed hoisting operation within a vertical mine shaft is provided with sets of modules of guide rollers which engage sectional guide beams or girders extending the length of the shafts to steady the passage of the conveyance up and down the shaft. Each modular guide roller set for the system incorporates three guide rollers mounted for ready access on the outside of the respective guide module, to facilitate repair or replacement thereof. The load absorbing components for each guide roller comprise an air bag, permitting specific pre-loading of the roller, and an elastomeric high rate bumper spring to accommodate impact loads, while providing rebound capability and associated hysteresis damping, for smooth, chatter free operation of the system. The system may be specifically set up to counter the significant torquing effect of the hoisting cable.

10 Claims, 3 Drawing Sheets

SPRING LOADED GUIDE ROLLERS

This application is a continuation-in-part of Ser. No. 07/476,095, Jan. 29, 1990, and a continuation-in-part of Ser. No. 07/219,595, Jul. 15, 1988, now abandoned.

TECHNICAL FIELD

This invention is directed to a guidance system for use in mine shaft hoists, and in particular to guide roller apparatus to facilitate high speed hoisting in a mine shaft.

BACKGROUND ART

The operation of a mine hoist in moving skips and cages vertically up and down within the hoist shaft is of great importance in the necessary movement of workers and mined product from underground.

The cost of excavating a deep shaft, and providing the necessary shaft guides within the hoistway, together with the cost of providing and operating the winding machinery and cable is such that efficient high speed hoisting plays an important role in the economic operation of the mine.

Mine shafts may extend vertically several thousand feet into the earth, such as 8,000 feet deep and safe, rapid hauling is of great importance.

Wooden or steel guides in aligned vertical relation, supported from the shaft timberwork, serve to provide guidance for the cage or skip in its passage up and down the shaft. These guides are subject to displacement and misalignment from earth settlement, and from general wear and tear, including the reactions generated by impacts from guide skids and guide rollers of the cages passing up and down.

At winding speeds in excess of fifteen hundred feet a minute the impacts resulting from misaligned guides can produce savage lateral displacement forces acting on the cage, the cable and by rope whip winding machinery, as well as the shaft guides. It should be born in mind that personnel also are transported by the system.

The stability of the cage in its passage up and down the hoistway is further influenced by the polar twisting torque of the hoisting cable, which torque is not constant but may have a considerable range of variation as the conveyance moves in the shaft.

Many systems of guide rollers have been tried in the mining industry, with varying degrees of success. However, the prior art hoist stabilizing systems have been incapable of providing adequate stability in guiding skips and cages to meet modern requirement in terms of hoisting speeds, increased tonnages and reliability.

Turning to the prior art, the guidance system disclosed in U.S. Pat. No. 4,434,876, utilizes a two-direction, two roll arrangement wherein the lateral displacement of each guide roll as it travels up and down a respective surface of a guide rail, is controlled by two coil springs. The two springs are connected in series, such that lateral displacement of the guide roll compresses both of the springs. The softer first spring operates within a protective yoke which limits the extent of total compression. Continued roll displacement is accommodated by further compression of the second, stiffer spring. Thus a progressive, two rate spring is provided.

The elements comprising the arrangement are poorly protected for operation in the damp, hostile and frequently corrosive environment of a mine shaft.

Certain prior art elevator roller guide arrangements, while being totally unsuited to use in mine shaft environments, understandably contain some elements in common with the present invention.

U.S. Pat. No. 3,099,344 Tucker, July 1963 shows an elevator roller guide arrangement having a pair of opposed guide rolls in facing relation to contact the sides of the guide rail, and a third roll at right angles thereto, bearing on the inner edge of the guide rail.

The pair of opposed guide rolls are mechanically tied together for synchronized lateral displacement, having centering springs, the actions of which are moderated by oil filled dashposts.

U.S. Pat. No. 2,260,922 Spiro, October 1941 shows an elevator car guide arrangement having sets of double-wheel bogies contacting the sides and inner edge of the guide rail. Each bogie comprises a centrally pivotted beam, the central pivots of which are supported by hydraulic cylinder to resiliently load the beam supported guide rolls against the respective beam surface. A common pressure source keeps the beams and the guide rolls uniformly loaded in balanced relation against the guide rail. However there appears to be no centering bias forces to keep the system centred and stable.

Both systems are inadequate and entirely unsuited to the environment of a mine shaft, and to meet the requirements of high hoisting speeds.

German Auslegeschrift 1067195 Abt, October 1959 is directed to guides for a mine cage, utilizing inclined rubber springs which can be preloaded and laterally displaced into position. The roll repositioning provisions are quite elaborate. This complex guide arrangement operates the main rubber "springs" in both shear and compression, and must be adjusted empirically for a desired load range.

DISCLOSURE OF INVENTION

The present invention provides a cage guidance system having one or more guidance modules, each module having at least two independent guide rolls for contacting surfaces of a guide rail in lateral, cage guiding relation.

It is usual to locate sets of positioning guides on the roof and under the floor of the hoist conveyance. It is likely that two such sets would be provided for each location, i.e. at the top and at the bottom of the conveyance. However, the use of double sets of guide rails would double the number of guidance sets, four at the top and four at the bottom of the conveyance.

The subject guidance modules preferably have three independent guide rolls, each rotatably mounted in externally accessible, removable relation with the module, to facilitate removal and replacement of a respective roll while the module is in installed relation on a cage.

The subject guidance modules further provide a spring biasing arrangement for biasing each roll independently of the other rolls.

The spring biasing means for each guidance module are located in sheltered relation remote from the respective guide rolls.

The spring biasing means for each guide roll may comprise an air bag, permitting by its inflation the displacement of the associated roll into contacting relation with a respective guide rail surface, and by inflation to a predetermined pressure, the application of a predetermined contact force to the respective guide roll. In addition, one or more elastomeric springs operating in direct compression, and in parallel with the related air bag for a predetermined portion of travel of the associated guide roll, provides guide roll return force and hysteresis damping effect to the respective guide roll.

The air bag provision permits loading of the guide roll against the respective guide rail surface, so as to substantially totally unload the elastomeric spring or springs, to thereby facilitate their ready removal from that guidance module. Thus, upon exhausting the air bag, the guide roll may be readily displaced on its supported pivots into an unloaded condition clear of the associated guide rail surface, to facilitate removal of the guide roll and its supporting shaft and bearings from the module.

It will be understood that this unloading of the respective guide rolls may also be utilized to facilitate removal of the total module, en mass.

In operation, the subject guidance system, having a plurality of such modules to contact the respective shaft guide rails, enables safe operation of skips and cages having loaded weight as high as 80,000 lbs., at speeds up to 3000 feet per minute, depending on conditions in the shaft.

Owing to the guidance characteristics provided by the air bag preload and the high speed rebound capacity and energy damping of the elastomeric springs, unusually good reliability, with reduced guide rail maintenance has been achieved.

In actual use in a given mine shaft, the measured lateral rebound accelerations acting upon the cage when using a guidance system in accordance with the present invention achieved operating values as low as 0.2 g, as compared with values in excess of 1.0 g for a prior art modern guidance system, using the same shaft. The improvement was achieved without requiring any significant modification to the guide rails.

In addition to reducing wear and tear on the skips cars and cages, and on the shaft guide rails, the impact loading and consequent wear and tear on the hoisting cable and the machinery also was significantly reduced, to provide notably extended serviceability thereto.

The present invention thus provides a guidance module for use in guiding relation with a hoist conveyance such as a skip or cage in cooperation with a shaft guide rail, the module comprising a support frame for attachment to the conveyance having at least one guide roll removably mounted for pivoting with a portion of the frame, a first pneumatic spring means in adjustable loading relation with the guide roll, and a second elastomeric spring means in adjustable loading relation with the guide roll for at least a portion of its travel, when in use, to cushion the impact of the guide roll and limit the displacement thereof.

In a preferred embodiment the module has three guide rolls removably mounted on the exterior of the frame in mutually independent movable relation therewith. The pneumatic spring means and the elastomeric spring means are preferably located in protected relation within the module support frame.

Each guide roll is mounted externally on a pivotal portion of the module frame, the guide roll being mounted on a shaft having support bearing therefor removably secured in pillow blocks located upon external surfaces of the frame, to facilitate ready removal of any one, or all of the guide rolls.

The pneumatic spring means have inflation conduit means connecting therewith, including quick connect controlling valve means therefor mounted in exterior accessible relation on the support frame.

In the preferred embodiment the support frame includes a pair of lateral frame portions pivotally secured thereto for angular lateral displacement relative thereto, being located one one each side of the frame in supporting relation with a respective guide roll, and each having a depending plate portion to substantially enclose a side portion of the frame.

The support frame includes a cover portion pivotally secured thereto, having a guide roll removably mounted externally on one face thereof, and a pneumatic spring means flanked by two elastomeric spring means secured to the other face of the cover portion.

The location of the elastomeric spring means in adjacent relation with the pneumatic spring means, to limit the pivotal travel of the cover portion, serves to limit the compressive force acting upon the pneumatic spring means, while applying rectifying forces to return the roll from the extremity of its displacement.

The guide rolls may include plastic tires, to enhance wear characteristics between the guide rolls and the guide rails. In the case of shafts having steel guide rails a urethane tire is generally preferred. In the case of shafts with wooden guide beams, a heavy duty tire such as an aircraft tire is preferred, in order to decrease surface pressure loading on the guide.

In use, with a crib, cage or other hoist conveyance having three or four guidance modules centering the conveyance in the shaft hoistway, inflation to a predetermined pressure of the air bags which comprise the pneumatic springs displaces the respective guide rolls into preloaded contact with the guide rails, thereby centering the conveyance between its guide rails.

The location of the elastomeric springs is then adjusted by the insertion of shims in spacing relation between the respective spring and the housing, usually to leave a predetermined small, free travel clearance, such that upon initial displacement of a respective roll from its balanced or rest position, until the free travel clearance is taken up and the elastomeric spring comes into play, the pneumatic spring is solely in effect.

BRIEF DESCRIPTION OF DRAWINGS

Certain embodiments of the invention are described by way of illustration, without limitation of the invention thereto, wherein.

BEST MODE OF CARRYING OUT THE INVENTION

Figure 1:
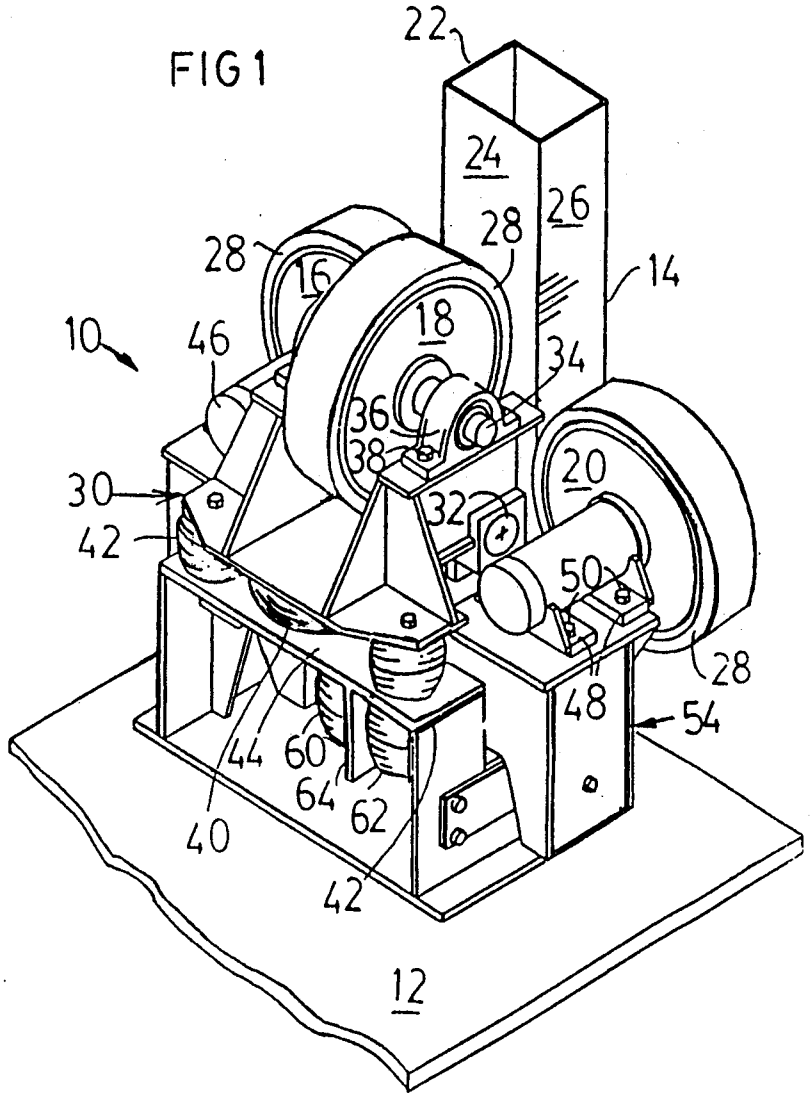
FIG. 1 is a perspective view from above showing a guidance module in accordance with the invention in its operative relation with a roof portion of a cage and a shaft guide rail.

Referring first to FIG. 1, a guidance module 10 is shown secured to a roof portion 12 of a conveyance, in guiding engagement thereof in relation to a guide rail 14. The module 10 has three guide rolls 16, 18, 20 in guiding contact with the side surfaces 22, 24, 26 of the guide rail 14. It will be understood that the guide rail 14 may be a timber or metal girder construction, braced laterally from the sides of the shaft (not shown).

Two or four such guidance modules will also be mounted on the bottom of the conveyance.

The guide rolls 16, 18, 20 are each provided with a solid urethane tire 28, to improve the noise and wear characteristics of the system, with the steel guide rail 14.

Figure 2:
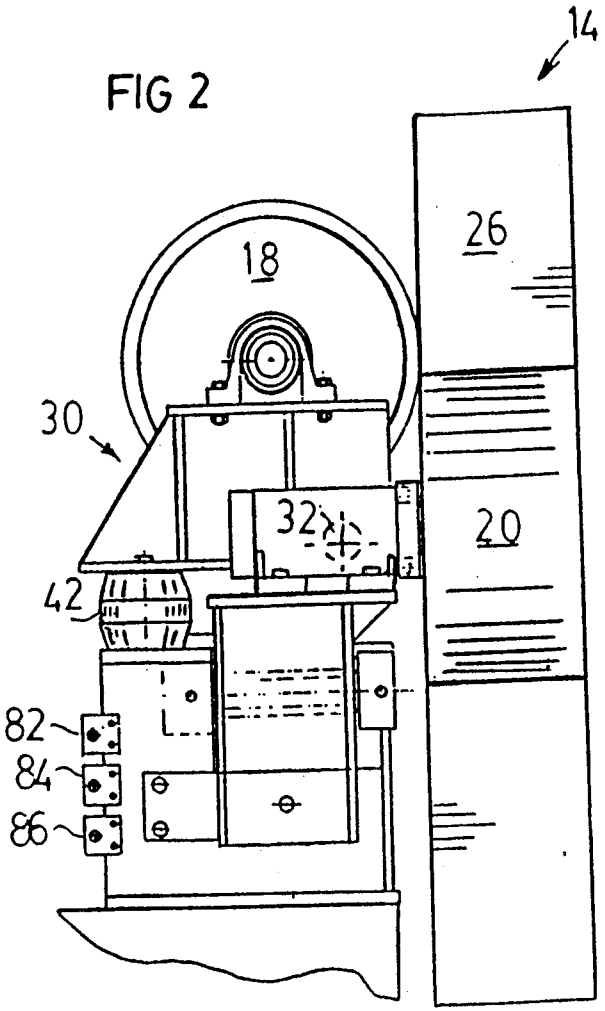
FIG. 2 is a side elevational view of the FIG. 1 embodiment.
Figure 3:
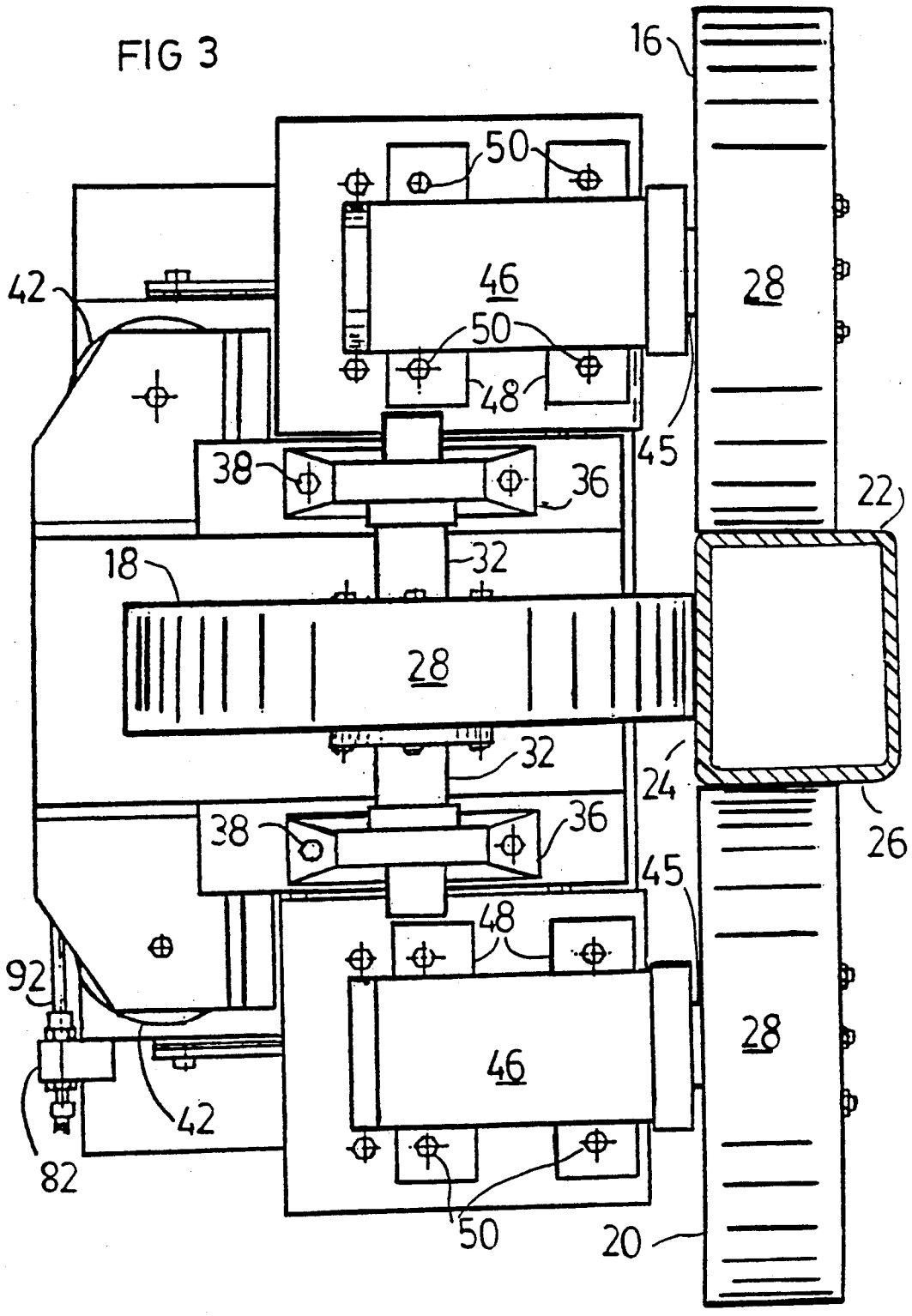
FIG. 3 is a plan view of the subject arrangement.
Figure 4:
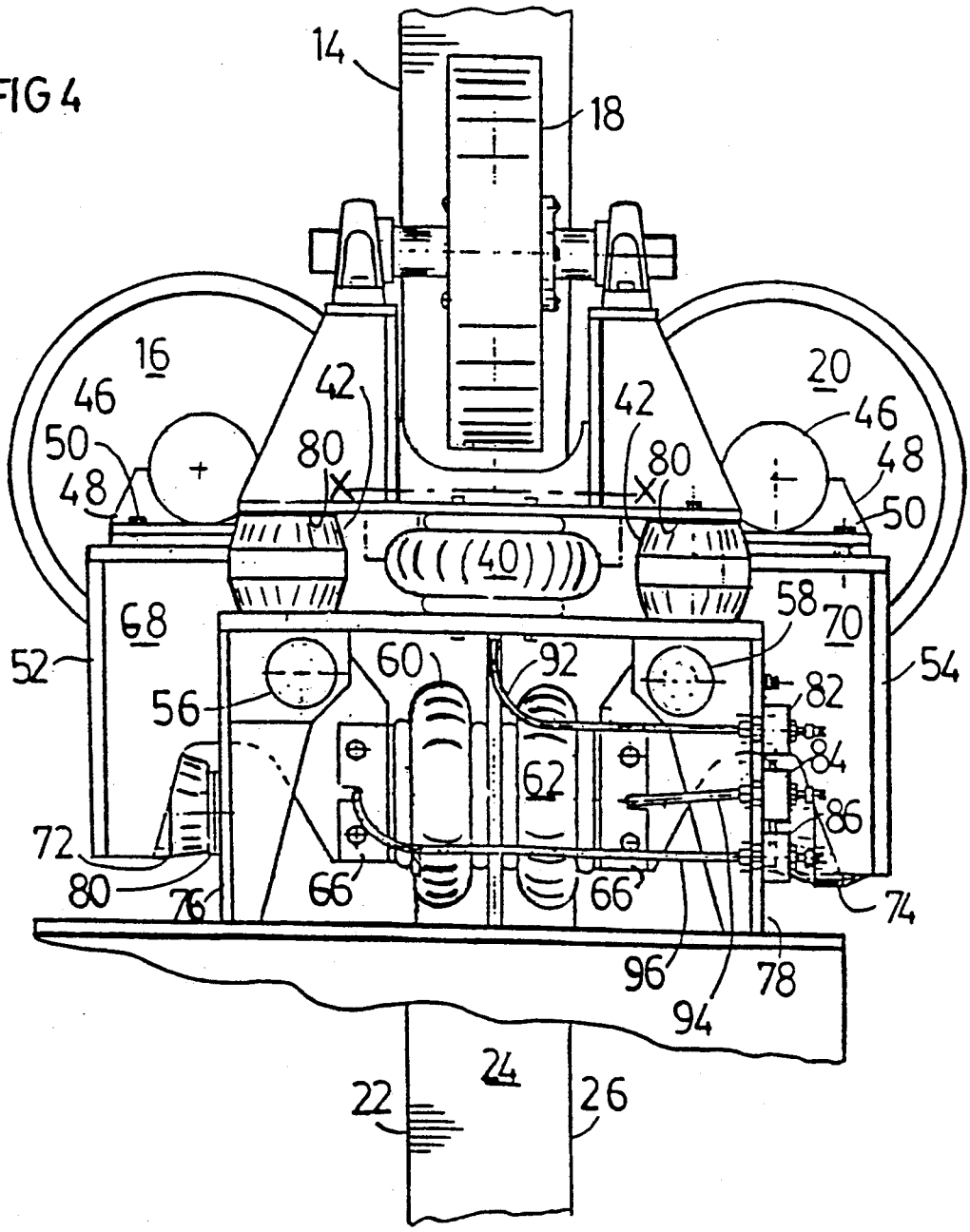
FIG. 4 is a elevational view, from the rear, of the FIG. 1 embodiment.

Referring also to FIGS. 2, 3 and 4, the centre guide roll 18 is carried on a pivotal frame portion 30, pivotting about axis XX on shaft 32 which extends laterally of the module 10.

The shaft 32 is secured to a fixed portion of module 10.

The guide roll 18 is mounted for rotation on shaft 34, having the bearings therefor mounted in pillow blocks 36, secured by bolts 38 to the frame portion 30.

An inflatable air bag 40 and two elastomeric springs 42, positioned in cushioning relation between frame portion 30 and a fixed portion 44 of the module 10 serve to maintain the guide roll 18 in guiding contact with the surface 24.

The mutually opposed side guide rolls 16, 20 (see FIGS. 1, 2 and 4) are rotatably mounted in cantilevered relation on shafts 45 carried within sealed bearing modules 46, 46.

The bearing modules 46, 46 are each removably secured by way of brackets 48 and bolts 50 to respective pivotal frame portions 52, 54.

The pivotal frame portions 52, 54 (see FIG. 4) are mounted on pivot shafts 56, 58, for lateral pivotting about, relative to the fixed portions of module 10.

Inflatable air bags 60, 62 on opposite sides of fixed partition portion 64 of module 10 are connected by brackets 66, 66 with web portions 68, 70 of pivotal frame portions 52, 54 respectively.

Elastomeric springs 72, 74 are interposed between pivotal frame portions 52, 54 and fixed frame members 76, 78.

The initial precise clearance between elastomeric springs 72, 74 and pivotal frame portions 52, 54 respectively, is adjusted by shims 80 of varying thickness.

Inflation valves 82, 84, 86 with quick disconnect attachments and air hoses 92, 94, 96 respectively connect with the air bags 40, 62 and 60.

In operation, the air bags 40, 60, 62 are initially set up at a predetermined setting pressure, usually in the range 10 to 50 pounds per square inch, in accordance with the torque correction requirement, and the nature frequency of the system.

INDUSTRIAL APPLICABILITY

The subject hoist guidance system is suited for hoisting applications, particularly high speed hoisting in vertical shafts.

What we claim by Letters Patent of the United States is:

1. A guidance module for use with a cable suspended hoist conveyance, in cooperation with a shaft guide rail, comprising a support frame for attachment to the conveyance, a pair of guide rolls removably pivotally mounted on the support frame in use to receive said guide rail therebetween, each roll having a first pneumatic spring means in individual, independently adjustable loading relation with the guide roll, and a second, elastomeric spring means in individual, independently adjustable loading relation with the guide roll for at least a portion of its travel, when in use to cushion the impact of the guide roll; wherein, in use, one said guide roll may be pre-loaded by the respective said pneumatic spring means to apply a force of a first magnitude against said guide rail, and the other said guide roll may be pre-loaded by the respective said pneumatic spring in an opposing sense and to a differing magnitude of force, in combination to apply a counter turning moment component to said hoist conveyance in opposing relation to a turning moment component imparted by said cable when connected in supporting relation with said hoist conveyance.

2. The guidance module as set forth in claim 1, said support frame having a third guide roll removably mounted on the exterior of said frame.

3. The guidance module as set forth in claim 2 having said first and second spring means located in protected relation within said support frame.

4. The guidance module as set forth in claim 3, having inflation conduit means connecting with said first spring means, and inflation controlling valve means therefor mounted in exterior accessible relation on said support frame.

5. The guidance module as set forth in claim 2, said three guide rolls each being individually mounted on a separate shaft located externally in supported relation on said frame, for ready removal therefrom.

6. The guidance module as set forth in claim 3, said elastomeric spring means being located adjacent said pneumatic spring means in protective relation therewith, to limit the deformation of said pneumatic spring means under load.

7. The guidance module as set forth in claim 1, said guide roll having an elastomeric cover about the periphery thereof to improve contact between the roll and said guide rail.

8. The guidance module as set forth in claim 1, in combination with a said cable suspended hoist conveyance and a second said guidance module; said second module having a pair of said guide rolls with a second said guide rail located therebetween, wherein said pneumatic spring means of said second module, in use, may be pre-loaded to apply a counter turning moment to said hoist conveyance to complement said counter turning moment of the other said module, and in opposing relation to said cable imparted turning moment.

9. A guidance module for use with a hoist conveyance in cooperation with a shaft guide rail, comprising a support frame for attachment to the conveyance, three guide rolls removably pivotally mounted on the support frame, each roll having a first pneumatic spring means in adjustable loading relation with the guide roll, and a second, elastomeric spring means in adjustable loading relation with the guide roll for at least a portion of its travel, when in use, to cushion the impact of the guide roll, said support frame having a pair of lateral frame portions pivotally secured thereto for angular lateral displacement relative thereto, being located one on each side of the frame, and each having a depending plate portion to substantially enclose a side portion of the frame.

10. A guidance module for use with a hoist conveyance in cooperation with a shaft guide rail, comprising a support frame for attachment to the conveyance, three guide rolls removably pivotally mounted on the support frame, each roll having a first pneumatic spring means in adjustable loading relation with the guide roll, and a second, elastomeric spring means in adjustable loading relation with the guide roll for at least a portion of its travel, when in use, to cushion the impact of the guide roll, said support frame having a cover portion thereof pivotally secured thereto, having one said guide roll removably mounted externally on one face thereof and a said pneumatic spring means and two said elastomeric spring means contacting the other face of said cover portion.

* * * * *